US009127617B2

(12) United States Patent
McGiffen et al.

(10) Patent No.: US 9,127,617 B2
(45) Date of Patent: Sep. 8, 2015

(54) INTERNAL COMBUSTION ENGINE HAVING IMPROVED COOLING ARRANGEMENT

(75) Inventors: Ian McGiffen, Scipio, IN (US); Joseph Worthington, Greenwood, IN (US); Keith A. Gunter, Long Buckby Northhamptonshire (GB)

(73) Assignee: Cummins Intellectual Property, Inc., Minneapolis, MN (US)

( * ) Notice: Subject to any disclaimer, the term of this patent is extended or adjusted under 35 U.S.C. 154(b) by 0 days.

(21) Appl. No.: 13/426,526

(22) Filed: Mar. 21, 2012

(65) Prior Publication Data

US 2012/0240883 A1 Sep. 27, 2012

Related U.S. Application Data

(60) Provisional application No. 61/454,869, filed on Mar. 21, 2011.

(51) Int. Cl.
*F02F 1/16* (2006.01)
*F02F 1/00* (2006.01)

(52) U.S. Cl.
CPC . *F02F 1/16* (2013.01); *F02F 1/163* (2013.01); *F02F 1/166* (2013.01); *F02F 2001/006* (2013.01)

(58) Field of Classification Search
CPC ..... F02F 1/16; F02F 1/166; F02F 1/163; F02F 2001/006
USPC ..... 123/41.72, 41.78, 41.79, 41.84, 193 C; 91/171
See application file for complete search history.

(56) References Cited

U.S. PATENT DOCUMENTS

| | | | | | |
|---|---|---|---|---|---|
| 3,853,099 | A | * | 12/1974 | Feather et al. | 123/41.82 R |
| 3,882,842 | A | * | 5/1975 | Bailey et al. | 123/193.2 |
| 4,729,347 | A | | 3/1988 | Schmitz | |
| 4,794,884 | A | | 1/1989 | Hilker et al. | |
| 5,080,049 | A | * | 1/1992 | Solomon et al. | 123/41.78 |
| 5,115,771 | A | | 5/1992 | Ozawa | |
| 5,251,578 | A | | 10/1993 | Kawauchi et al. | |
| 5,299,538 | A | | 4/1994 | Kennedy | |
| 5,505,167 | A | | 4/1996 | Kennedy | |
| 5,596,954 | A | | 1/1997 | Kennedy | |
| 5,669,339 | A | | 9/1997 | Yukawa et al. | |
| 6,079,375 | A | | 6/2000 | Duerr et al. | |
| 6,116,198 | A | | 9/2000 | Kirtley et al. | |
| 6,145,481 | A | | 11/2000 | Bock et al. | |
| 6,167,848 | B1 | * | 1/2001 | Frantzheld | 123/41.79 |

(Continued)

OTHER PUBLICATIONS

International Search Report and Written Opinion of the International Searching Authority dated Jun. 19, 2012 from corresponding International Application No. PCT/JP2012/030001.

*Primary Examiner* — Lindsay Low
*Assistant Examiner* — Jacob Amick
(74) *Attorney, Agent, or Firm* — Faegre Baker Daniels LLP

(57) ABSTRACT

An improved cooling fluid passage configuration provides for uniformity of cooling about the entire periphery of a cylinder liner of an internal combustion engine in addition to improved cooling by increasing the flow in an upper water jacket of a split water jacket design. The cooling fluid passage configuration also provides a reduced pressure drop between a cylinder liner cooling fluid inlet and a cylinder head cooling fluid outlet when compared to conventional designs with a single head feed line, permitting use of a smaller cooling fluid pump and leading to increased efficiency of the engine.

22 Claims, 6 Drawing Sheets

(56) References Cited

U.S. PATENT DOCUMENTS

| | | | |
|---|---|---|---|
| 6,328,001 | B1 | 12/2001 | Kirtley et al. |
| 6,363,894 | B1 | 4/2002 | Barkman |
| 6,394,046 | B2 | 5/2002 | Moller et al. |
| 6,675,750 | B1 | 1/2004 | Wagner |
| 2005/0257756 | A1 | 11/2005 | Endoh et al. |

* cited by examiner

INTERNAL COMBUSTION ENGINE HAVING IMPROVED COOLING ARRANGEMENT

CROSS-REFERENCE TO RELATED APPLICATIONS

This application claims the benefit of priority to U.S. Provisional Patent Application No. 61/454,869, filed on Mar. 21, 2011, which is hereby incorporated by reference in its entirety.

TECHNICAL FIELD

This disclosure relates to coolant or cooling fluid passages between a cylinder liner and an engine block of an internal combustion engine and the configuration for connecting these coolant passages to a cylinder head attached to the engine block.

BACKGROUND

Cooling of internal combustion engines is required because of the high temperatures generated within the engine, particularly in the area of an engine's combustion chamber, which includes the cylinder liner and the cylinder head. While cooling is a required function of internal combustion engines, cooling represents a parasitic loss on an engine, reducing efficiency. Additionally, cooling of cylinder liners, particularly at a ring reversal location, has been challenging. Thus, there remain opportunities to improve the cooling of internal combustion engines while reducing the parasitic loss from the cooling system on such engines.

SUMMARY

This disclosure provides an internal combustion engine comprising an engine body, a cylinder head, a first head feed line, a second head feed line, a cylinder liner, a first transfer passage and a second transfer passage. The engine body includes a cylinder bore and a cooling fluid inlet communicating with the cylinder bore. The cylinder head is attached to the engine block. The first head feed line and the second head feed line are positioned in the engine body. The first head feed line is positioned as a spaced angle along a circumference of the cylinder bore from the second head feed line. The cylinder liner is positioned in the cylinder bore. The cylinder liner cooperates with the engine block to form an upper cylinder liner water jacket and a lower cylinder liner water jacket. The lower cylinder liner water jacket is positioned to receive cooling fluid from the cooling fluid inlet. The first transfer passage is located in the engine body between the first head feed line and the second head feed line at a spaced angle along the cylinder bore circumference from the second head feed line. The second transfer passage is located in the engine body between the first head feed line and the second head feed line at a spaced angle along the cylinder bore circumference from the second head feed line on an opposite side of the second head feed line from the first transfer passage. The first transfer passage and the second transfer passage are positioned to provide cooling fluid flow from the lower cylinder liner water jacket to the upper cylinder liner water jacket. The upper cylinder liner water jacket has a cross sectional fluid flow area less than a cross sectional fluid flow area of the lower cylinder liner water jacket.

This disclosure also provides an internal combustion engine comprising an engine body, a cylinder head, a first head feed line, a second head feed line, a cylinder liner, a first transfer passage and a second transfer passage. The engine body includes a cylinder bore and a cooling fluid inlet communicating with the cylinder bore. The cylinder head is attached to the engine block. The first head feed line and the second head feed line are positioned in the engine body. The first head feed line includes a first cross sectional fluid flow area and the second head feed line includes a second cross sectional fluid flow area The first head feed line is positioned as a spaced angle along a circumference of the cylinder bore from the second head feed line. The cylinder liner is positioned in the cylinder bore. The cylinder liner cooperates with the engine block to form an upper cylinder liner water jacket and a lower cylinder liner water jacket. The lower cylinder liner water jacket is positioned to receive cooling fluid from the cooling fluid inlet. The first transfer passage is located in the engine body between the first head feed line and the second head feed line at a spaced angle along the cylinder bore circumference from the second head feed line. The second transfer passage is located in the engine body between the first head feed line and the second head feed line at a spaced angle along the cylinder bore circumference from the second head feed line on an opposite side of the second head feed line from the first transfer passage. The first transfer passage and the second transfer passage are positioned to provide cooling fluid flow from the lower cylinder liner water jacket to the upper cylinder liner water jacket. The ratio of the first cross sectional fluid flow area to the second cross sectional fluid flow area provides cooling fluid flow about the circumference of the cylinder liner.

This disclosure also provides an internal combustion engine comprising an engine body, a cylinder head, a first head feed line, a second head feed line, a cylinder liner, a first transfer passage and a second transfer passage. The engine body includes a cylinder bore and a cooling fluid inlet communicating with the cylinder bore. The cylinder head is attached to the engine block. The first head feed line and the second head feed line are positioned in the engine body. The first head feed line includes a first cross sectional fluid flow area and the second head feed line includes a second cross sectional fluid flow area The first head feed line is positioned as a spaced angle along a circumference of the cylinder bore from the second head feed line. The cylinder liner is positioned in the cylinder bore. The cylinder liner cooperates with the engine block to form an upper cylinder liner water jacket and a lower cylinder liner water jacket. The lower cylinder liner water jacket is positioned to receive cooling fluid from the cooling fluid inlet. The first transfer passage is located in the engine body between the first head feed line and the second head feed line at a spaced angle along the cylinder bore circumference from the second head feed line. The second transfer passage is located in the engine body between the first head feed line and the second head feed line at a spaced angle along the cylinder bore circumference from the second head feed line on an opposite side of the second head feed line from the first transfer passage. The first transfer passage and the second transfer passage are positioned to provide cooling fluid flow from the lower cylinder liner water jacket to the upper cylinder liner water jacket. The upper cylinder liner water jacket has a third cross sectional fluid flow area that is less than a fourth cross sectional fluid flow area of the lower cylinder liner water jacket, and the ratio of the first cross sectional fluid flow area to the second cross sectional fluid flow area and the ratio of the third cross sectional fluid flow area to the fourth cross sectional fluid flow area provides cooling about the entire circumference of the cylinder liner at a top ring reversal location.

Advantages and features of the embodiments of this disclosure will become more apparent from the following detailed description of exemplary embodiments when viewed in conjunction with the accompanying drawings.

DETAILED DESCRIPTION

Throughout this disclosure, the term water should be understood to mean any conventional cooling fluid or coolant suitable for use in internal combustion engines. Therefore, the term "water" should not be considered as limiting.

Referring to FIGS. 1-6, the present disclosure is directed to an internal combustion engine, or an engine body, a portion of which is shown in a cross sectional view and generally indicated at 10. Engine body 10 provides improved cooling of a cylinder liner 12 and a cylinder head 14, simultaneously reducing the parasitic loss on engine 10, increasing the efficiency of engine 10. As discussed hereinbelow, engine 10 includes various features, some of which include various configuration parameters resulting in improved cooling that achieves certain desired characteristics, such as reduced temperature at the top ring reversal location and reduced pressure drop of cooling fluid flowing into cylinder head 14. The improved cooling of cylinder liner 12 also increases the mean time between engine overhauls, directly addressing a customer desire.

Figure 1:
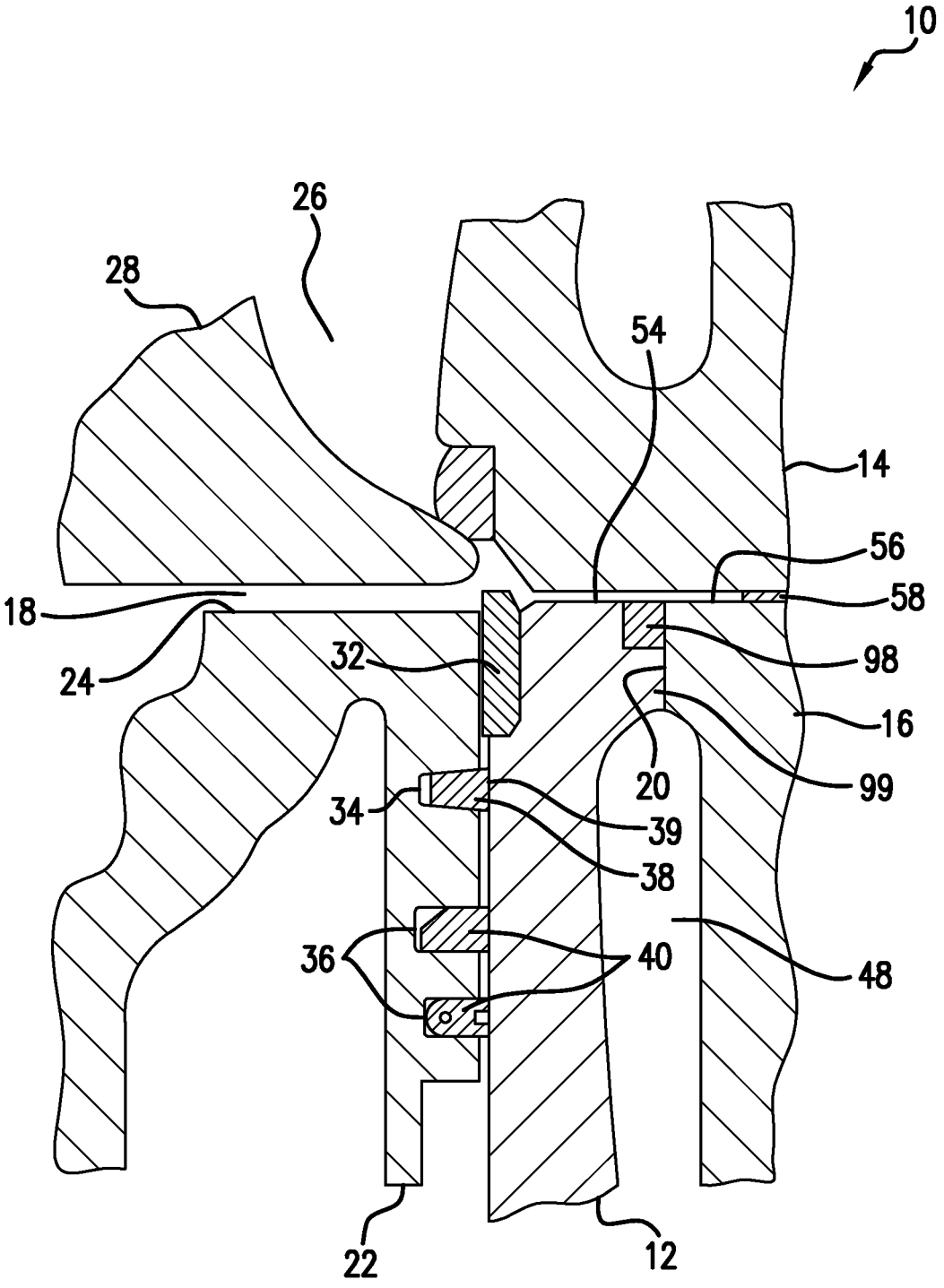
FIG. 1 is a first sectional view of a portion of an internal combustion engine in accordance with an exemplary embodiment of the present disclosure.

Engine 10 includes an engine block 16, a small portion of which is shown, and at least one combustion chamber 18. Of course, engine 10 may contain a plurality of combustion chambers, for example four, six or eight, which may be arranged in a line or in a "V" configuration. Each combustion chamber 18 is located at one end of a cylinder cavity 20, which may be formed directly in engine block 16. Cylinder cavity 20 is adapted to receive removable cylinder liner 12. Engine 10 also includes cylinder head 14 that attaches to engine block 16 to close cylinder cavity 20. Engine 10 further includes a piston 22 positioned for reciprocal movement within each cylinder liner 12 in association with each combustion chamber 18. Although only a top portion of piston 22 is shown in FIG. 1, piston 22 may be any type of piston so long as it contains the features identified hereinbelow necessary for accomplishing the present disclosure. For example, piston 22 may be an articulated piston or a single piece piston.

An upper surface or top face 24 of piston 22 cooperates with cylinder head 14 and the portion of cylinder liner 12 extending between cylinder head 14 and piston 22 to define combustion chamber 18. A scraper ring 32 may be positioned in cylinder liner 12 to remove soot and other debris from an exterior of piston 22 as piston 22 passes by scraper ring 32. Piston 22 also includes a top groove 34 and a plurality of other grooves 36. Top groove 34 includes a top compression ring 38. Grooves 36 include other rings or seals 40. Top compression ring 38 and rings and seals 40 separate combustion chamber 18 from other internal portions of engine 10, particularly those internal portions that receive a splashed lubricant.

One key to cylinder liner, piston ring, and piston longevity is minimizing the top ring reversal temperature. The top ring reversal temperature is the temperature of top compression ring 38 when piston 22 is at a top dead center (TDC) position, described hereinbelow, and about to change direction from an upward stroke to a downward stroke, as shown in FIG. 1. The longitudinal or axial location of top compression ring 38 with respect to cylinder liner 12 when piston 22 is at its reversal point may be described as a top ring reversal location 39. If the top ring reversal temperature is too high, then excessive wear of cylinder liner 12 and piston ring 38 occurs, shortening the life of cylinder liner 12 and piston ring 38. However, groove 34, which holds piston ring 38, can only be positioned outwardly or longitudinally higher by ensuring adequate cooling of piston ring 38, which is subject to the temperatures of combustion chamber 18. Thus, merely locating piston ring 38 higher without assuring piston ring 38 can be properly cooled can lead to early failure of piston ring 38 and cylinder liner 12. The present disclosure describes a configuration that enables a higher position for groove 34 and ring 38 than in conventional designs, which improves the life and reliability of cylinder 12.

Although not specifically illustrated, piston 22 connects to a crankshaft of engine 10 by way of a connecting rod that causes piston 22 to reciprocate along a rectilinear path within cylinder liner 12 as the engine crankshaft rotates. FIG. 1 illustrates the position of piston 22 in the TDC position achieved when the crankshaft is positioned to move piston 22 to the furthest most position away from the rotational axis of the crankshaft. In a conventional manner, piston 22 moves from the TDC position to a bottom dead center (BDC) position when advancing through intake and power strokes. For purposes of this disclosure, the words "outward" and "outwardly" correspond to the direction away from the engine crankshaft and the words "inward" and "inwardly" correspond to the direction toward the engine crankshaft or the BDC position of piston 22.

Engine 10 of the present disclosure may be a four-cycle compression ignition (diesel) engine employing direct injection of fuel into each combustion chamber 18. One or more passages 26 formed in cylinder head 14 selectively direct intake air into combustion chamber 18 or exhaust gas from combustion chamber 18 by way of a respective poppet valve 28 positioned in cylinder head 14, only one of which is illustrated in FIG. 1. There may be two poppet valves 28 associated with intake passages and two poppet valves 28 associated with exhaust passages. The opening and closing of poppet valves 28 may be achieved by a mechanical cam or hydraulic actuation system (not shown) or other motive system in carefully controlled time sequence with the reciprocal movement of piston 22.

At the uppermost, TDC position shown in FIG. 1, piston 22 has just completed its upward compression stroke during which charge air allowed to enter combustion chamber 18 from an intake passage is compressed, thereby raising its temperature above the ignition temperature of the engine's fuel. This position is usually considered the zero position commencing the 720 degrees of rotation required to complete four strokes of piston 22. The amount of charge air that is caused to enter combustion chamber 18 and the other combustion chambers of engine 10 may be increased by providing a pressure boost in engine 10's intake manifold (not shown). This pressure boost may be provided, for example, by a turbocharger (not shown), including a compressor driven by a turbine powered by engine 10's exhaust or driven by engine 10's crankshaft (not shown).

Figure 2:
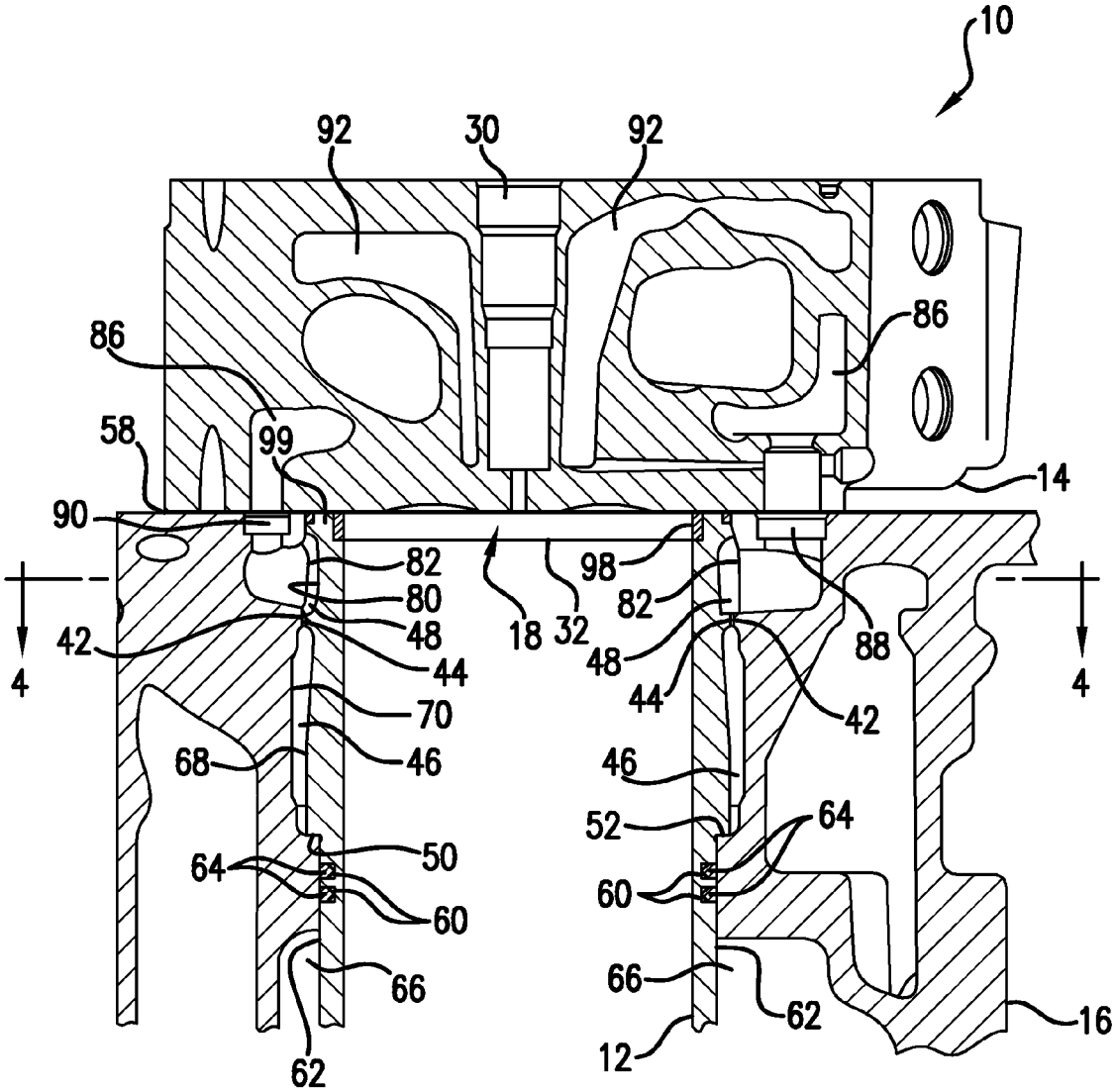
FIG. 2 is a sectional view of a portion of the internal combustion engine of FIG. 1 along the lines 2-2 in FIG. 4, through the feed lines that extend from the engine block to the cylinder head and as though the cylinder head, the engine block and the cylinder liner were whole.

Referring to FIG. 2, engine 10 also includes a fuel injector (not shown), securely mounted in an injector bore 30 formed in cylinder head 14, for injecting fuel at very high pressure into combustion chamber 18 when piston 22 is approaching, at, or moving away from, the TDC position. The fuel injector includes, at its inner end, an injector nozzle assembly that further include a plurality of injection orifices, formed in the lower end of a nozzle assembly, for permitting high-pressure fuel to flow from a nozzle cavity of the fuel injector into combustion chamber 18. The fuel flow is at a very high pressure to induce thorough mixing of the fuel with the high temperature, compressed charge air within combustion chamber 18. It should be understood that the fuel injector might be any type of injector capable of injecting high-pressure fuel through a plurality of injector orifices into combustion chamber 18. For example, the fuel injector may be a closed nozzle injector or an open nozzle injector. A nozzle valve element positioned in the fuel injector may be a conventional spring-biased closed nozzle valve element actuated by fuel pressure, such as disclosed in U.S. Pat. No. 5,326,034, the entire content of which is incorporated by reference. The fuel injector may be in the form of the injector disclosed in U.S. Pat. No. 5,819,704, the entire content of which is hereby incorporated by reference.

The engine of the present disclosure includes cylinder liner coolant passages sized, shaped, and/or positioned relative to one another, as described hereinbelow, to advantageously provide improved cooling to cylinder liner 12 and to cylinder head 14. The improved cooling permits locating top compression ring 38 as high as possible on piston 22, or outwardly along piston 22, because the ring reversal temperature is reduced in comparison to conventional designs. Locating top compression ring 38 higher, or longitudinally or axially outward, on piston 22 is beneficial in reducing emissions since the space between top surface 24 of piston 22 and top compression ring 38, sometimes referred to as a dead space, provides a location for hydrocarbons to remain unburned. The improved cooling also reduces parasitic losses from the coolant system on engine 10. The reduced ring reversal temperature also improves the mean time between engine overhauls as well as improving the reliability of engine 10.

Cylinder liner 12 includes an annular protrusion 42 that mates with one or more land segments 44 on engine block 16 to create a lower cylinder liner coolant, e.g., water, jacket 46 and an upper cylinder liner water jacket 48. Cylinder liner 12 may be described as a split liner because it cooperates with engine block 16 to form two or more water jacket portions. As will be described in more detail hereinbelow, separating the water jacket located about the circumference of cylinder liner 12 into two portions enables improved cooling of cylinder liner 12 at top ring reversal location 39.

Cylinder liner 12 also includes an annular stop or step 50 that engages an annular land or stop 52 located on engine block 16. Stop 50 provides a location that sets the depth or offset of a proximate, near or upper surface 54 of cylinder liner 12 with respect to a top surface 56 of engine block 16. Stop 50 sets the axial length of the gap between top surface 54 of cylinder liner 12 and cylinder head 14 or a cylinder head gasket 58 that is part of engine 10 and is located between engine block 16 and cylinder head 14. A stop having similarity to stop 50 is described in U.S. Pat. No. 4,294,203, issued Oct. 12, 1981, the entire content of which is hereby incorporated by reference.

One or more grooves 60 may also be positioned on an outer wall 62 of cylinder liner 12. One or more seals 64 may be positioned in each groove 60. Seals 64 separate a lubricated portion 66 located between engine block 16 and cylinder liner 12 from lower cylinder liner water jacket 46. Lubricated portion 66 receives splashed engine lubricant that lubricates moving parts of engine 10. An upper liner seal 98 may be radially located between a radially extending portion 99 of cylinder liner 12 and engine block 16 to retain cooling fluid within upper cylinder liner water jacket 48.

Figure 3:
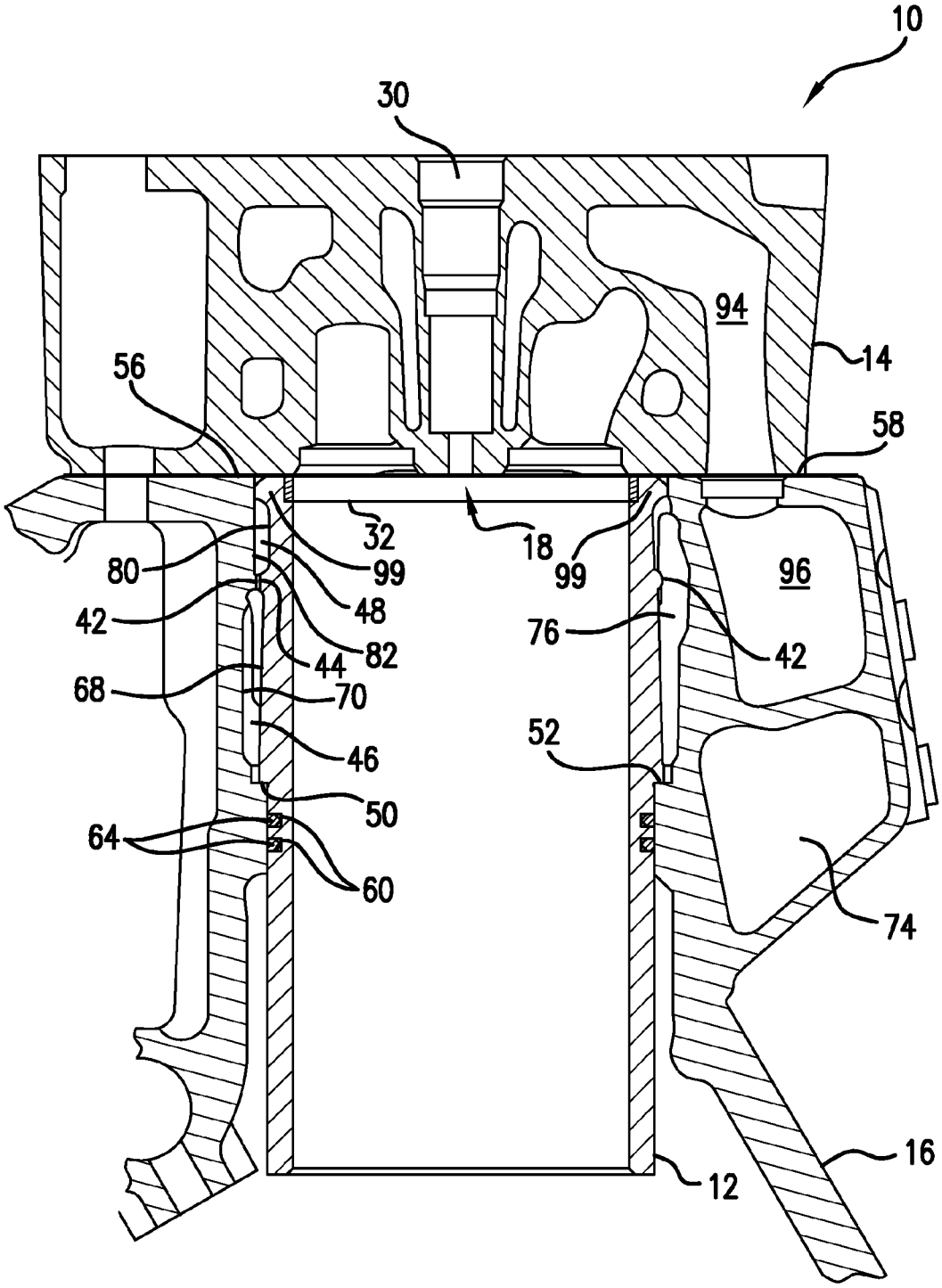
FIG. 3 is a sectional view of a portion of the internal combustion engine of FIG. 1 along the lines 2-2 in FIG. 4, as though the cylinder head, the engine block and the cylinder liner were whole.

As shown in FIGS. 2 and 3, lower cylinder liner water jacket 46 is radially located between an outer wall portion 68 of cylinder liner 12 and an inner wall portion 70 of engine block 16 and extends angularly around the entire periphery of cylinder liner 12. Lower cylinder liner water jacket 46 also extends longitudinally or axially from stop 50 to annular protrusion 42. Upper cylinder liner water jacket 48 is located between an inner wall portion 80 of cylinder liner 12 and an inner wall portion 82 of engine block 16 and extends angularly around the circumference of cylinder liner 12. Upper cylinder liner water jacket 48 also extends longitudinally or axially from annular protrusion 42 to radially extending portion 99. Upper cylinder liner water jacket 48 may have approximately 33% to 50% of the volume of lower cylinder liner water jacket 46. This relationship also means that lower cylinder liner water jacket 46 may be approximately in the range 2-3 times larger than upper cylinder liner water jacket 48. A block inlet 72 (FIGS. 5 and 6) connects cooling fluid from a block water feed rail 74 located in engine 10 to lower cylinder liner water jacket 46. Block water feed rail 74 is connected to an engine heat exchanger (not shown). As previously noted, annular protrusion 42 cooperates with land 44 to separate lower cylinder liner water jacket 46 from upper cylinder liner water jacket 48. A first water transfer passage 76 and a second water transfer passage 78 extending longitudinally or axially from lower cylinder liner water jacket 46 to upper cylinder liner water jacket 48 fluidly connects upper cylinder liner water jacket 48 to lower cylinder liner water jacket 46, permitting cooling fluid flow from lower cylinder water jacket 46 to upper cylinder water jacket 48. The center of second water transfer passage 78 may be separated circumferentially from the center of first water transfer passage 76 by an angle 84 that may be in the range 90-180 degrees, but is preferably about 120 degrees.

Figure 6:
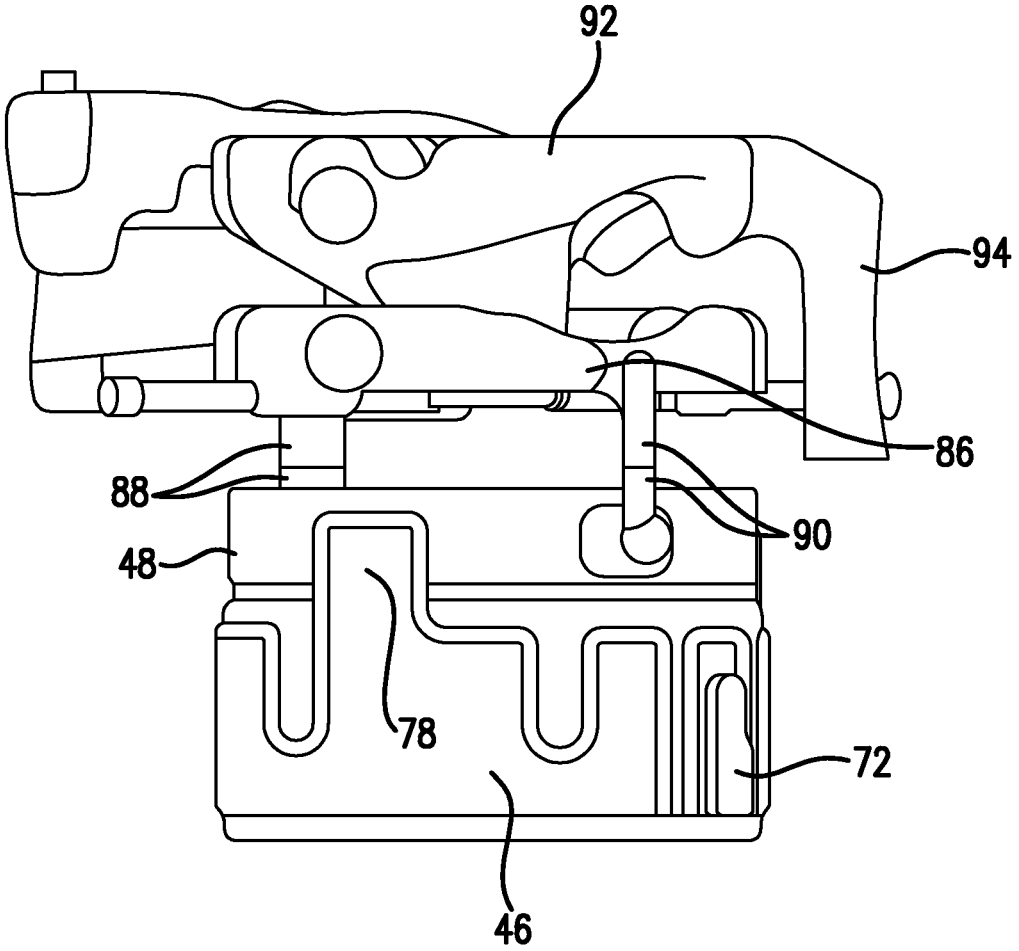
FIG. 6 is a stylized view of the fluid passages between the cylinder liner and the engine block, the connection of those passages to the cylinder head, and the fluid passages in the cylinder head of the internal combustion engine of FIG. 1, as though the fluid passages were solid.

As shown in FIGS. 2 and 6, upper cylinder liner water jacket 48 fluidly connects to a lower cylinder head water jacket 86, located in cylinder head 14, by a first longitudinally extending head feed line 88 and a second longitudinally extending head feed line 90, each located in engine block 16 and cylinder head 14. First feed line 88 has cross sectional fluid flow area that is approximately in the range 2-3 times the cross sectional fluid flow area of second head feed line 90, and more preferably in the range 2-2.5 times the cross sectional fluid flow area of second head feed line 90 to optimize cooling of cylinder head 14. For example, second head feed line 90 may have a diameter of approximately 16 millimeters and first head feed line 88 may have a diameter in the range 30-50 millimeters, or more preferably in the range 35-45 millimeters. As will be described hereinbelow, the difference in cross sectional fluid flow area may work with other features of engine 10, e.g., the location of first head feed line 88 and second head feed line 90, to assure adequate cooling fluid flow through second head feed line 90.

Figure 4:
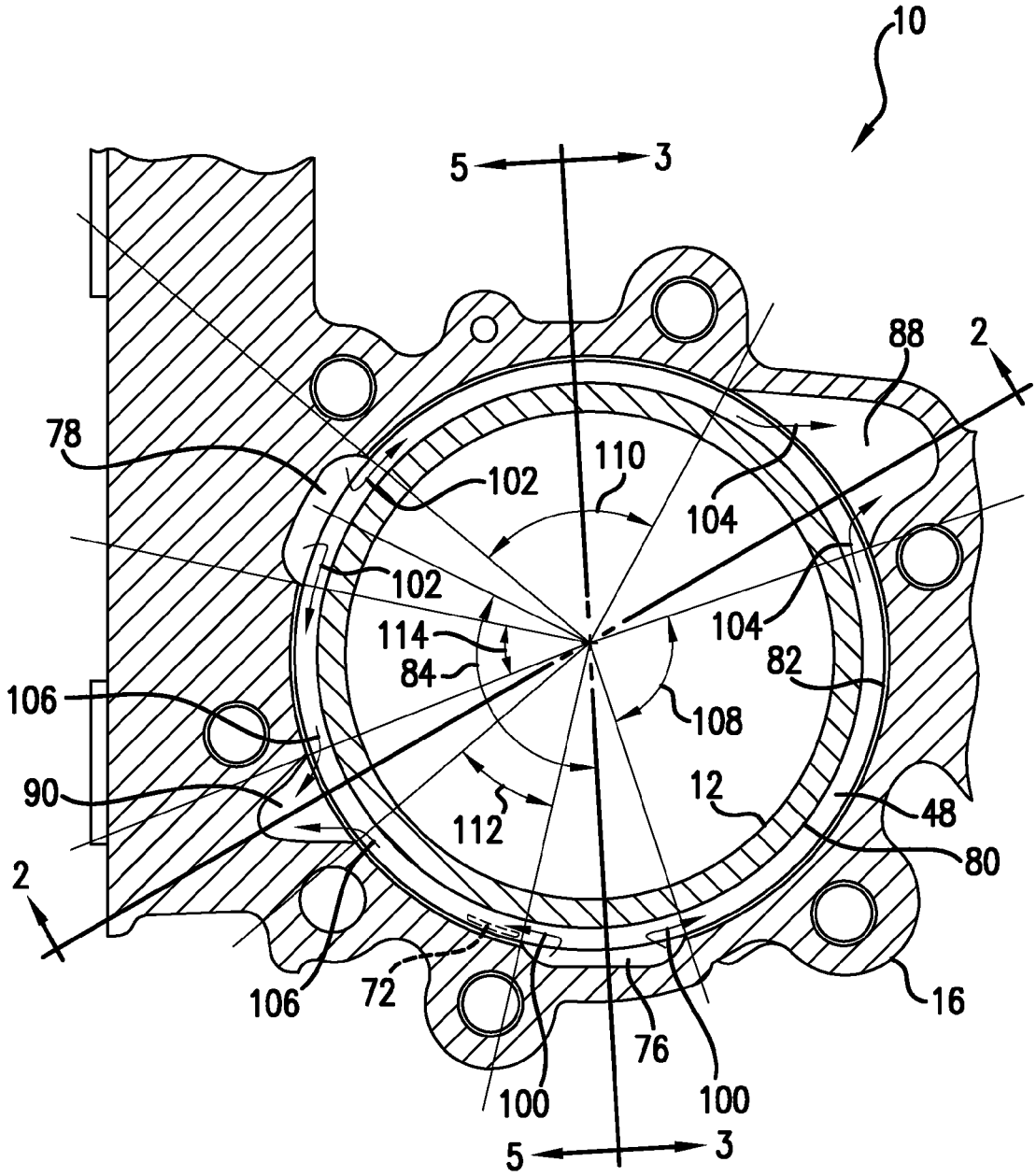
FIG. 4 is a sectional view along the lines 4-4 in FIG. 1, as though the components in FIG. 1 were whole.
Figure 5:
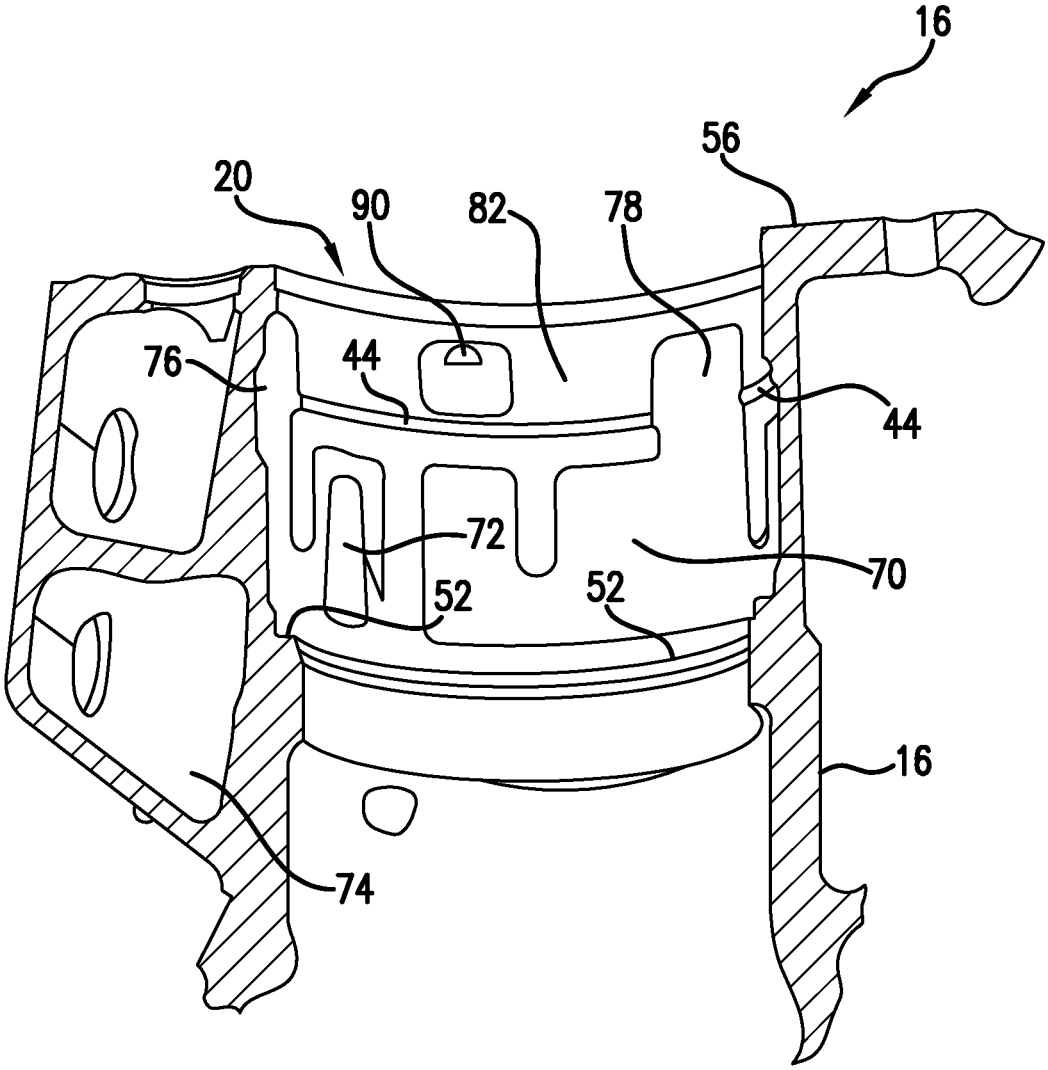
FIG. 5 is a sectional view of a portion of the engine block of the internal combustion engine of FIG. 1 along the lines 5-5 in FIG. 4 with the cylinder liner removed.

As best seen in FIG. 4, first head feed line 88 is located circumferentially between first water transfer passage 76 and second water transfer passage 78. A first edge of first head feed line 88 may be circumferentially positioned at an angle 108 that may be in the range 84-94 degrees from a first edge of first water transfer passage 76. A second edge of first head feed line 88 may be circumferentially positioned at an angle 110 that may be in the range 73-83 degrees from a first edge of second water transfer passage 78. A center of first head feed line 88 may be circumferentially about halfway between the center of first water transfer passage 76 and a center of second water transfer passage 78, or approximately 120 degrees from a center of each passage. Second head feed line 90 is located circumferentially between first water transfer passage 76 and second water transfer passage 78 on an opposite side of first water transfer passage 76 and second water transfer passage 78 from first head feed line 88. A first edge of second head feed line 90 may be circumferentially positioned at an angle 112 that may be in the range 32-42 degrees from a second edge of first water transfer passage 76 and a second edge of second head feed line 90 may be circumferentially positioned at an angle 114 that may be in the range 28-38 degrees circumferentially from a second edge of second water transfer passage 78. A center of second head feed line 90 may be located approximately halfway between the center of first water transfer passage 76 and the center of second water transfer passage 78. The center of second head feed line 90 may be circumferentially located in the range 45-90 degrees from the center of first water transfer passage 76 and in the range 45-90 degrees from the center of second water transfer passage 78 or may preferably be circumferentially located approximately 65 degrees from the center of first water transfer passage 76 and approximately 55 degrees from the center of second water transfer passage 78.

Lower cylinder head water jacket 86 fluidly connects to an upper cylinder head water jacket 92. Upper cylinder head water jacket 92 fluidly connects to a water return transfer passage 94 located between cylinder head 14 and engine block 16. Transfer passage 94 fluidly connects to a block water return rail 96 located in engine block 16. Block water return rail 96 fluidly connects to an engine heat exchanger (not shown).

To understand the unique physical characteristics of engine 10, and more specifically the characteristics of the coolant passages formed in cylinder liner 12, engine block 16, and cylinder head 14, attention is directed to FIGS. 1-6 illustrating the various physical characteristics or parameters that function to achieve the unexpected cooling improvements of the present disclosure. As will be explained in more detail hereinbelow, the combination of physical characteristics and parameters provide the advantages of the present disclosure. The specific configuration, and more importantly, the critical dimensions and dimensional relationships described hereinbelow result in the improved functional performance of the present disclosure.

Cooling fluid from an engine heat exchanger flows through block water feed rail 74 into block inlet 72. The cooling fluid flows through lower cylinder liner water jacket 46 about the periphery of cylinder liner 12. Referring to FIG. 4, the cooling fluid then flows through first water transfer passage 76 along paths 100 and through second water transfer passage 78 along paths 102 into upper cylinder liner water jacket 48. As previously noted, upper cylinder liner water jacket 48 has a cross sectional fluid flow area that is approximately 50% the cross sectional fluid flow area of lower cylinder liner water jacket 46. The net effect of this change in cross sectional fluid flow area is that the velocity of cooling fluid increases in upper cylinder liner water jacket 48 as compared to the velocity of cooling fluid in lower cylinder liner water jacket 46. The velocity increase may be in the range 2-3 times. For example, the cooling fluid velocity in lower cylinder liner water jacket 46 may be in the range 1.0-1.5 meters per second and the cooling fluid velocity in the upper cylinder liner water jacket 48 may be in the range 2.5-3.0 meters per section. The rate of cooling fluid flow through the lower cylinder liner water jacket 46 and the upper cylinder liner water jacket 48 under the aforementioned flow rate conditions may be 50 gallons per minute.

Rapidly moving cooling fluid flows toward first head feed line 88 and second head feed line 90 for transfer into cylinder head 14. Because of the circumferentially offset position of first water transfer passage 76 and second water transfer passage 78 with respect to first head feed line 88 and second head feed line 90, and because of the relative size of second head feed line 90 with respect to first head feed line 88, cooling fluid flow proceeds circumferentially from first water transfer passage 76 and from second water transfer passage 78 toward both first head feed line 88 and second head feed line 90. The locations of first water transfer passage 76 and second water transfer passage 78 is established by the configuration of engine block 16. Because first head feed line 88 is circumferentially further from first water transfer passage 76 and second water transfer passage 78 than second head feed line 90, first head feed line 88 is given a larger cross sectional fluid flow area in comparison to second head feed line 90 to decrease the resistance to cooling fluid flow through first head feed line 88. By sizing and positioning first head feed line 88 and second head feed line 90 as described, cooling fluid flow through second head feed line 90 is increased to a level that is sufficient to assure relatively uniform cooling of cylinder liner 12 about its circumference. Thus, the entire periphery or circumference of cylinder liner 12 is uniformly cooled in the area of top ring reversal location 39 because the flow of cooling fluid is balanced into first head feed line 88 and second head feed line 90 to provide uniformity of cooling.

As just described, the balanced fluid flow is accomplished by two physical features of engine 10. First, the circumferential position of first water transfer passage 76 and the circumferential position of second water transfer passage 78 with respect to first head feed line 88 and second head feed line 90. Second, the cross sectional fluid flow area of first head feed line 88 and the cross sectional fluid flow area of second head feed line 90, previously described, affects the ratio of cooling fluid flow into first head feed line 88 along paths 104 and into second head feed line 90 along paths 106, leading to sufficient cooling fluid flow into first head feed line 88 and second head feed line 90 to provide relatively uniform cooling about the circumference of cylinder liner 12. In addition to providing uniform cooling about the entire periphery of cylinder liner 12, which is beneficial in uniform cooling at top ring reversal location 39, the increased velocity of the cooling fluid in upper cylinder liner water jacket 48 provides increased cooling to top ring reversal location 39.

The result of the increased and uniform cooling permits locating top ring reversal location 39 higher on cylinder liner 12. Positioning top ring reversal location 39 higher permits an outwardly or axially higher location of top groove 34 on piston 22 as compared to conventional designs, which have to keep the top ring reversal location lower to accommodate variations in cooling about the periphery of cylinder liner 12 and to accommodate the lesser cooling provided by such designs. The improved cooling of top ring reversal location 39 decreases oil breakdown at top ring reversal location 39, decreasing wear on cylinder liner 12. Decreased wear on cylinder liner 12 reduces oil consumption in engine 10 and decreases the mean time between overhauls for engine 10, thus improving the reliability and lifetime of engine 10. The improved cooling of top ring reversal location 39 also permits a higher power density or power capability in engine 10.

First head feed line 88 and second head feed line 90 connect to lower cylinder head water jacket 86, guiding cooling fluid throughout the hottest portion of lower cylinder head water jacket 86 in the areas nearest to combustion chamber 18. The cooling fluid then flows into upper cylinder head water jacket 92. From upper cylinder head water jacket 92, the cooling water flows into water return transfer passage 94 and then into block water return rail 96. Block water return rail 96 ultimately connects to an engine heat exchanger (not shown), such as a radiator.

The combination of first head feed line 88 and second head feed line 90 decreases the pressure drop between upper cylinder liner water jacket 48 and lower cylinder head water jacket 86 as compared to conventional engine designs. The reduced pressure drop permits use of a smaller cooling fluid pump (not shown) in engine 10, which decreases the parasitic load on engine 10 from the cooling fluid pump, which improves the efficiency of engine 10.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. An internal combustion engine, comprising:

an engine body including a cylinder bore and a cooling fluid inlet communicating with the cylinder bore;

a cylinder head attached to the engine body;

a first head feed line and a second head feed line positioned in the engine body, a center of the first head feed line positioned at a spaced angle along a circumference of the cylinder bore from a center of the second head feed line;

a cylinder liner positioned within the cylinder bore and having an annular protrusion that cooperates with land segments projecting from the engine body and extending circumferentially about the cylinder bore to separate an upper cylinder liner water jacket from a lower cylinder liner water jacket, the lower cylinder liner water jacket positioned to receive cooling fluid from the cooling fluid inlet;

a first transfer passage in the engine body disposed between the land segments and along the circumference of the cylinder bore between the first head feed line and the second head feed line, the first transfer passage being bounded in part by the cylinder liner; and a second transfer passage in the engine body disposed between land segments and along the circumference of the cylinder bore between the first head feed line and the second head feed line, the second transfer passage being bounded in part by the cylinder liner;

wherein the first transfer passage and the second transfer passage extend above and below the land segments to provide cooling fluid flow from the lower cylinder liner water jacket to the upper cylinder liner water jacket; and wherein the first transfer passage is arranged along the circumference of the cylinder bore to provide cooling fluid flow to both the first head feed line and the second head feed line and the second transfer passage is arranged along the circumference of the cylinder bore to provide cooling fluid flow to both the first head feed line and the second head feed line.

2. The internal combustion engine of claim 1, wherein a cross sectional fluid flow area of the upper cylinder liner water jacket is in a range 33%-50% of a cross sectional fluid flow area of the lower cylinder liner water jacket.

3. The internal combustion engine of claim 1, wherein a first edge of the first head feed line is in a range 84-94 degrees circumferentially from a first edge of the first transfer passage and a second edge of the first head feed line is in a range 73-83 degrees circumferentially from a first edge of the second transfer passage.

4. The internal combustion engine of claim 1, wherein a first edge of the second head feed line is circumferentially in a range 32-42 degrees from a second edge of the first transfer passage.

5. The internal combustion engine of claim 1, wherein a velocity of cooling fluid flow through the upper cylinder liner water jacket is approximately twice a velocity of cooling fluid flow through the lower cylinder liner water jacket.

6. The internal combustion engine of claim 5, wherein the velocity of cooling fluid flow through the upper cylinder liner water jacket is in a range 2.5-3.0 meters per second at a rate of 50 gallons per minute.

7. The internal combustion engine of claim 1, wherein a second edge of the second head feed line is circumferentially in a range 28-38 degrees from a second edge of the second transfer passage.

8. The internal combustion engine of claim 1, wherein the first head feed line has a cross sectional fluid flow area that is in a range 2-3 times as large as a cross sectional fluid flow area of the second head feed line.

9. The internal combustion engine of claim 8, wherein the first head feed line has a cross sectional fluid flow area that is in a range 2-2.5 times the cross sectional fluid flow area of the second head feed line.

10. The internal combustion engine of claim 9, wherein the second head feed line has a diameter of 16 millimeters.

11. An internal combustion engine, comprising:

an engine body including a cylinder bore and a cooling fluid inlet communicating with the cylinder bore;

a cylinder head attached to the engine body;

a first head feed line including a first cross sectional fluid flow area and a second head feed line including a second cross sectional fluid flow area positioned in the engine body, a center of the first head feed line positioned at a spaced angle along a circumference of the cylinder bore from a center of the second head feed line;

a cylinder liner positioned within the cylinder bore and having an annular protrusion that cooperates with land segments projecting from the engine body and extending circumferentially about the cylinder bore to separate an upper cylinder liner water jacket from a lower cylinder liner water jacket, the lower cylinder liner water jacket positioned to receive cooling fluid from the cooling fluid inlet;

a first transfer passage located in the engine body disposed between the land segments and bounded in part by the cylinder liner, a center of the first transfer passage positioned between the center of the first head feed line and the center of the second head feed line at a spaced angle along the cylinder bore circumference from the center of the second head feed line, and a second transfer passage located in the engine body disposed between the land segments and bounded in part by the cylinder liner, a center of the second transfer passage positioned between the center of the first head feed line and the center of the second head feed line at a spaced angle along the cylinder bore circumference from the center of the second head feed line on an opposite side of the second head feed line from the first transfer passage, the first transfer passage and the second transfer passage positioned to provide cooling fluid flow from the lower cylinder liner water jacket to the upper cylinder liner water jacket, the ratio of the first cross sectional fluid flow area to the second cross sectional fluid flow area controls cooling fluid flow about the circumference of the cylinder liner; and wherein the first transfer passage and the second transfer passage extend above and below the land segments to provide cooling fluid flow from the lower cylinder liner water jacket to the upper cylinder liner water jacket; and wherein the first transfer passage is arranged along the circumference of the cylinder bore to provide cooling fluid flow to both the first head feed line and the second head feed line and the second transfer passage is arranged along the circumference of the cylinder bore to provide cooling fluid flow to both the first head feed line and the second head feed line.

12. The internal combustion engine of claim 11, wherein the ratio of the first cross sectional fluid flow area to the second cross sectional fluid flow area is in a range 2-3.

13. The internal combustion engine of claim 12, wherein the ratio of the first cross sectional fluid flow area to the second cross sectional fluid flow area is in a range 2-2.5.

14. The internal combustion engine of claim 10, wherein a cross sectional fluid flow area of the upper cylinder liner water jacket is in a range 33%-50% of a cross sectional fluid flow area of the lower cylinder liner water jacket.

15. The internal combustion engine of claim 11, wherein a first edge of the second head feed line is circumferentially in a range 32-42 degrees from a second edge of the first transfer passage.

16. The internal combustion engine of claim 11, wherein a second edge of the second head feed line is circumferentially in a range 28-38 degrees from a second edge of the second transfer passage.

17. An internal combustion engine, comprising:

an engine body including a cylinder bore and a cooling fluid inlet communicating with the cylinder bore;

a cylinder head attached to the engine body;

a first head feed line including a first cross sectional fluid flow area and a second head feed line including a second cross sectional fluid flow area positioned in the engine body, a center of the first head feed line positioned at a spaced angle along a circumference of the cylinder bore from a center of the second head feed line;

a cylinder liner positioned within the cylinder bore and having an annular protrusion that cooperates with land segments projecting from the engine body and extending circumferentially about the cylinder bore to separate an upper cylinder liner water jacket and a lower cylinder liner water jacket, the lower cylinder liner water jacket positioned to receive cooling fluid from the cooling fluid inlet;

a first transfer passage located in the engine body and bounded in part by the cylinder liner; and a second transfer passage located in the engine body and bounded in part by the cylinder liner;

wherein the first transfer passage and the second transfer passage extend above and below the land segments to provide cooling fluid flow from the lower cylinder liner water jacket to the upper cylinder liner water jacket;

wherein the first transfer passage is arranged along the circumference of the cylinder bore to provide cooling fluid flow to both the first head feed line and the second head feed line and the second transfer passage is arranged along the circumference of the cylinder bore to provide cooling fluid flow to both the first head feed line and the second head feed line; and wherein a ratio of the first cross sectional fluid flow area to the second cross sectional fluid flow area and a ratio of the third cross sectional fluid flow area to the fourth cross sectional fluid flow area provides increased rate of cooling fluid flow about the entire circumference of the cylinder liner at a top ring reversal location.

18. The internal combustion engine of claim 17, wherein the third cross sectional fluid flow area is in a range 33%-50% of the fourth cross sectional fluid flow area and the ratio of the first cross sectional fluid flow area to the second cross sectional fluid flow area is in a range 2-3.

19. The internal combustion engine of claim 18, wherein the ratio of the first cross sectional fluid flow area to the second cross sectional fluid flow area is in a range 2-2.5.

20. The internal combustion engine of claim 17, wherein the velocity of the cooling fluid flow in the lower cylinder liner water jacket is in a range 1.0-1.5 meters per section and the velocity of the cooling fluid flow in the upper cylinder liner water jacket is in a range 2.5-3.0 meters per second.

21. The internal combustion engine of claim 1, wherein the centers of the first and second transfer passages are circumferentially further from the center of the first head feed line than the center of the second head feed line.

22. The internal combustion engine of claim 21, wherein a first cross sectional fluid flow area of the first head feed line is larger than a second cross sectional fluid flow area of the second head feed line.

* * * * *